United States Patent [19]

Simikoski

[11] 3,960,354

[45] June 1, 1976

[54] CORNER PROTECTOR

[76] Inventor: Wayne L. Simikoski, 3504 S. Mozart, Chicago, Ill. 60632

[22] Filed: Jan. 6, 1975

[21] Appl. No.: 538,620

[52] U.S. Cl. ..... 248/345.1; 108/27; 229/DIG. 1

[51] Int. Cl.[2] ..... A47B 95/00

[58] Field of Search ..... 16/86 R, 86 A; 108/27; 190/37; 49/460, 461, 462; 206/512, 521; 229/DIG. 1; 220/85 K; 248/345.1; 312/137; 267/139, 140, 141

[56] References Cited

UNITED STATES PATENTS

| | | | |
|---|---|---|---|
| 2,233,694 | 3/1941 | Cramer et al. | 248/345.1 X |
| 2,633,252 | 3/1953 | Friedman | 248/345.1 X |
| 2,885,139 | 5/1959 | Werner et al. | 229/DIG. 1 UX |
| 2,993,673 | 7/1961 | Villar | 206/521 X |
| 2,995,863 | 8/1961 | Bright | 190/37 X |
| 3,041,775 | 7/1962 | Brown et al. | 248/345.1 |
| 3,093,924 | 6/1963 | Pompa | 248/345.1 |
| 3,144,236 | 8/1964 | Clanin | 248/345.1 |
| 3,150,854 | 9/1964 | Jamieson | 248/345.1 |
| 3,655,034 | 4/1972 | Stollman et al. | 206/521 X |
| 3,725,188 | 4/1973 | Kalt | 229/DIG. 1 UX |

FOREIGN PATENTS OR APPLICATIONS

| | | | |
|---|---|---|---|
| 983,168 | 6/1951 | France | 248/345.1 |

*Primary Examiner*—Roy D. Frazier
*Assistant Examiner*—Lawrence J. Staab
*Attorney, Agent, or Firm*—Bernard L. Kleinke

[57] ABSTRACT

A corner protector adapted to extend over a corner portion of an object of furniture, such as a table, for protecting against injuries to small children or other people falling accidentially against the corner portion, includes an upper plate composed of impact-absorbing material and a depending skirt portion composed of impact-absorbing material for overlying the respective upper and vertical surfaces of the corner portion of the object. The skirt portion includes a pair of side walls and a smoothly contoured front wall joining the pair of side walls, the front wall being configured to be disposed substantially rearwardly of a imaginary intersection of the planes of the side walls. The protector is attached releasably to the object of furniture by a suitable adhesive and by elastic bands stretched between adjacent corner protectors. A pair of elongated blocks may be fixed to the plate and extend along and engage the inside surfaces of the side walls to serve as spacers. Different pairs of blocks are provided, each pair of blocks being configured differently, to accommodate different shapes of corner portions, such as square corners, rounded corners or corners of hexagonal tables or the like.

7 Claims, 4 Drawing Figures

CORNER PROTECTOR

The present invention relates to a corner protector for furniture, and it more particularly relates to a furniture corner protector which is adapted to be attached to existing furniture for protecting against accidential injuires to small children or other people who may inadvertently fall against the corner portion of the furniture.

Corner guards or protectors have been attached to items of furniture, such as tables, chairs or the like, to protect against damaging the furniture and to protect against injuring people, especially small children who may accidentially fall aginst the protruding corners or other sharp edged surfaces of the furniture. For example, reference may be made to U.S. Pat. Nos. 2,633,252; 3,041,775; and 3,150,854. Each one of these patents discloses a guard or protector which is adapted to be attached to a square corner of an object. While the guards or protectors disclosed in the foregoing patents may be suitable for some applications, it would be highly desirable to have a corner protector which is adapted to fit over and be attached to different shapes of corners. In this regard, such a protector should be adapted to be secured to an object having square corners, rounded corners or other angles, such as the corners of a hexagonalshaped table. None of the square-shaped corner guards of the foregoing patents would be suitable for use on different shapes of corner portions since they all have inside surfaces which are complementary shaped relative to a square corner. If they were used on a table having rounded corners, for example, there would be a substantial space between the front corner of the guard and the corner of the table. Such a space would be highly undesirable since the protector would not adequately provide protection if the front portion of the guard would deform or collapse under impact. Therefore, it would be extremely desirable to have a corner protector which is adapted to be attached to the corner portion of an object for protection purposes, and yet be able to accommodate various different shapes of corner portions. Such protectors should be relatively inexpensive to manufacture and easy to use, while being esthetically pleasing. Such a corner protector must securely fit different shapes of objects without leaving any substantial gaps.

Therefore, the principal object of the present invention is to provide a new and improved corner protector which is adapted to fit securely different shapes of corner portions of objects, and which is inexpensive to manufacture, easy to use, and esthetically pleasing in appearance.

Briefly, the above and further objects of the present invention are realized by providing a corner protector including an upper plate composed of impact-absorbing material and a depending skirt portion composed of impact-absorbing material for overlying respectively the upper and vertical surfaces of the corner portion of the object for protection purposes. The skirt portion includes a pair of side walls and a smoothly contoured front wall joining the pair of side walls, the front wall being configured to be disposed substantially rearwardly of an imaginary intersection of the planes of the side walls. The protector is releasably attached to the object to be protected, by adhesive material and/or elastic strips stretching between adjacent protectors. A plurality of differently-configured pairs of elongated blocks are provided so that one of the pairs may be fixed to the plate and extend along and engage the inside surfaces of the side walls to serve as spacers. Thus, the protector can securely and conveniently attach to rounded corners, square corners, or corners having different angles.

The above, and still further highly important objects and advantages of the invention will become apparent from the following detailed specification, apended claims, and attached drawing, herein:

Figures 1, 2, 3, 4:
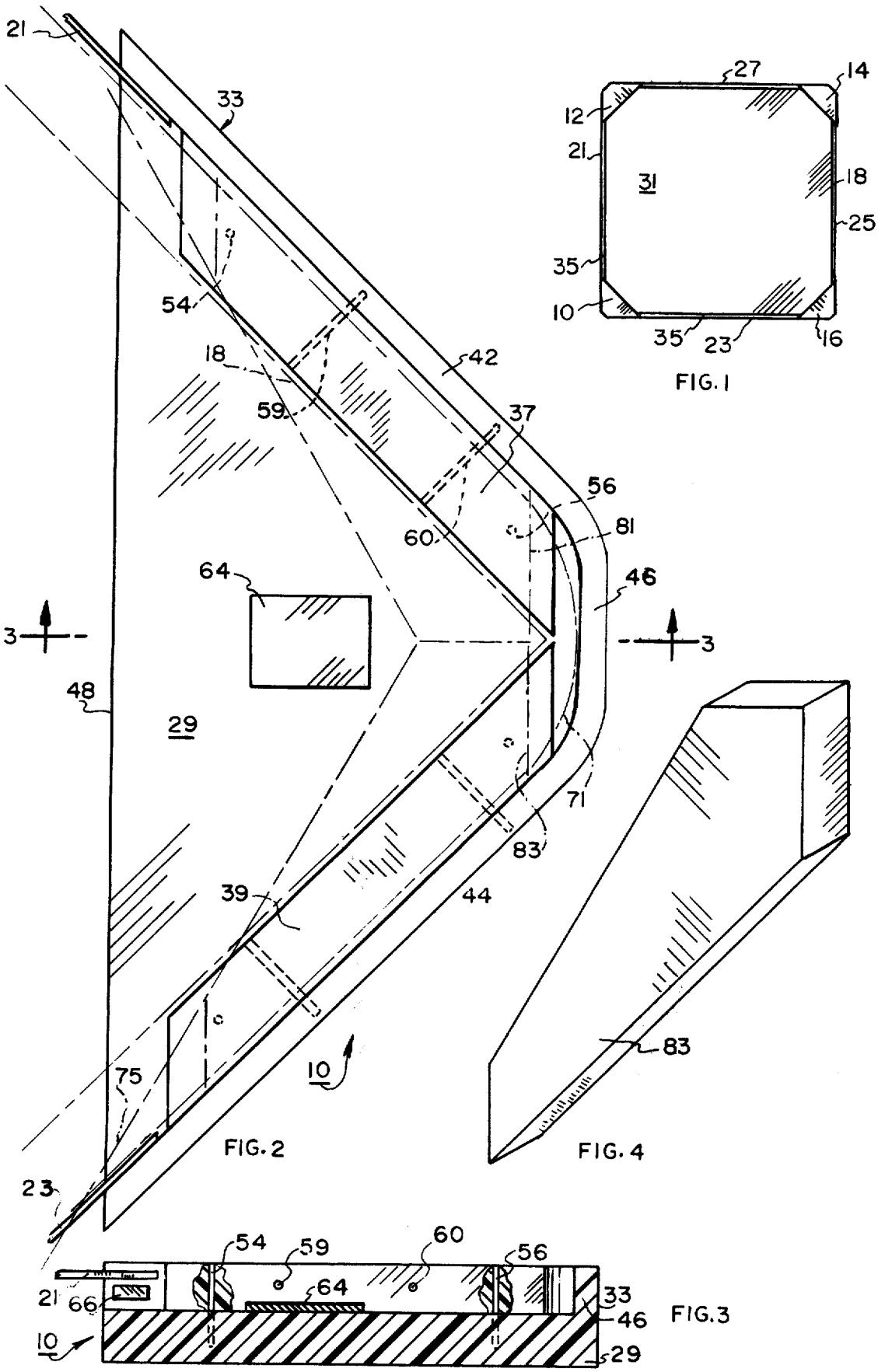
FIG. 1 is a plan view of a table top having attached to its corner portions four corner protectors which are constructed in accordance with the present invention.
FIG. 2 is an enlarged plan view of the underside of one of the corner protectors of FIG. 1.
FIG. 3 is a cross-sectional view, partly broken away, of the corner protector of FIG. 2, taken substantially along the line 3—3 thereforeof.
FIG. 4 is a pictorial view of an alternate block which may be used with the protector of FIG. 2 for enabling it to fit a different shape of a corner portion of an object.

Referring now to the drawings, and more particularly to FIG. 1 thereforeof, there is shown four corner protectors 10, 12, 14, and 16, which are attached to the corner portions of a table 18, and which are constructed in accordance with the present invention. The table 18 has square corners, but as hereinafter described in greated detail, the protectors of the present invention are adapted to fit different shapes of corner portions of different objects, such as end tables, coffee tables, chairs, and other types and kinds of furniture. The protectors may also be used for any type or kind of corner portion of object to protect the object from being damaged and to protect small children or other people from falling against protruding corner portions of an object and injuring themselves. In order to partially secure the corner protectors to the table 18, a pair of elastic strips 21 and 23 are stretched between the protector 10 and its adjacent protectors 12 and 16, respectively. Similarly, a pair of elastic straps 25 and 27 are stretched between the protector 14 and its adjacent protectors 16 and 12, respectively.

As shown in FIGS. 2 and 3 of the drawings, the protector 10 will now be described since the other three protectors are all similar to it. The protector 10 includes an upper triangularly-shaped plate 29 which is adapted to overlie the upper horizontal surface 31 of the table 18, and a depending generally V-shaped skirt 33 adapted to overlie the vertical surfaces 35 of the table 18 at its corner portion for protection purposes. As hereinafter described in greater detail, a pair of elongated blocks 37 and 39 are fixed to the underside of the plate 29 and extend along and are fixed to the inside surfaces of the skirt portion 33 to serve as spacers when the protector 10 is to be used with a square corner of an object to be protected. Both the plate 29 and the depending skirt 33 are composed of an impact-absorbing material such as an expanded synthetic resinous material. For example, the material may be STYROFOAM which is a registered trademark. As shown in FIG. 3 of the drawings, the plate 29 and the skirt 33 are of a one-piece construction, however it is to be understood that a two-piece contruction may also be employed.

Considering now the protector 10 in greater detail with reference to FIGS. 2 and 3 of the drawings, the skirt portion 33 includes a pair of side walls 42 and 44 and a smoothly contoured front wall 46 joining the pair of side walls 42 and 44 at the front portion of the protector 10. The front wall 46 is configured to be disposed substantially rearwardly of an imaginary intersection of the planes of the side walls in accordance with the present invention. As a result, the protector 10 may be securely attached to various different shapes of corners with the front wall 46 disposed in relatively close proximity to the outermost portion of the corner to be protected. Also, by employing a smooth stiff yet resilient material such as STYROFOAM, the front wall 46 does not readily collapse completely upon impact to provide for better protection. The front wall 46 is generally rectilinear and extends in a direction parallel to the back edge 48 of the plate 29. However, it is to be understood that the front wall 48 could have other shapes in accordance with the present invention. For example, the front wall 46 could be curved.

The blocks 37 and 39 serve as spacers between the table 18 and the side walls 42 and 44, respectively, and the blocks also serve to provide additional impact-absorbing properties of the protector 10. The blocks 37 and 39 are generally square in cross-section and are uniform in crosssection throughout their length.

Considering now how the blocks are attached to the protectors, only the block 37 will now be considered since the block 39 is attached in a similar manner. A pair of pins or rods 59 and 60 are pushed into and extend through the block 37 into the side wall 42 to secure the block 37 thereto. A pair of pins or rods 54 and 56 are pushed into the block 37 and, as best seen in FIG. 3, extend into the plate 29 for the purpose of securing the block 37 thereto. In order to secure the protector to the table, a pressure sensitive adhesive sheet 64 is secured to the underside of the plate 29 so that it may be releasably attached to the upper table surface 31 of the table 18. Similarly, a pair of short pressure sensitive adhesive strips, such as the strip 66, are secured to the inside surfaces of the side walls 42 and 44 for releasably securing them to the vertical surfaces 35 of the table 18.

The protector 10 can also be used with tables having rounded corners. As shown in FIG. 2 of the drawings, when the protector 10 is used with such a table, the blocks 37 and 39 are not used. The protector 10 then is secured to a table as indicated by the broken line 71 without the need for any blocks for spacing purposes.

The protector 10 can also be used with hexagonal tables; and in this regard, as shown in FIG. 2 a hexagonal table as indicated by broken line 75 can be accommodated by the protector 10. In this regard, the blocks 37 and 39 are not used, but instead a pair of blocks shown in broken lines 81 and 83 in FIG. 2 are employed. As shown in FIG. 4, the block 83 which is similar to the block 81 is generally square in cross-section, but it becomes progressively larger in cross-sectional area from the rear to the front end thereof. The tapered shape of the two blocks 81 and 83 enable them to accommodate the corner of the hexagonal table. The front end portions of the two blocks 81 and 83 are disposed adjacent one another near the front wall, and the two blocks 81 and 83 are inclined toward one another.

What is claimed is:

1. A corner protector adapted to extend over a corner portion of an object having upper and vertical surfaces, comprising: an upper plate composed of impact-absorbing material and a depending skirt portion composed of impact-absorbing material for overlying respectively the upper and vertical surfaces of the corner portion of the object for protection purposes, said skirt portion having a pair of side walls and having a smoothly contoured front wall joining said pair of side walls, said side walls having inner portions adapted to engage said vertical surfaces, said skirt portion having an inner front wall portion joining the side wall inner portions, said inner front wall portion being disposed substantially rearwardly of an imaginary intersection of the planes of said side walls to accommodate said corner portion, means for attaching releasably said plate and said skirt to the object to be protected, and a pair of elongated blocks fixed to the plate and extending along and engaging the inner portions of the side walls to serve as spacers for accommodating other differently-shaped corner portions.

2. A corner protector according to claim 1, wherein said upper plate has its side edges inclined forwardly toward one another, said blocks being inclined fowardly toward one another and terminating at their front end portions in close proximity to one another to the rear of said front wall.

3. A corner protector according to claim 2, wherein each one of said blocks is uniform in cross-section throughout its length.

4. A corner protector according to claim 2, wherein each one of said blocks is tapered from end to end and is progressively larger in cross-sectional area from its rear end portion to its front end portion.

5. A corner protector according to claim 2, wherein said plate, said skirt portion and said blocks are all composed of a synthetic resinous material.

6. A corner protector according to claim 1, wherein said plate includes a back edge, said inner and the outer front wall portions being rectilinear and extending in a substantially parallel direction to the back edge of said plate.

7. A corner protector according to claim 1, further including a plurality of similar other corner protectors, said means for attaching releasably including a plurality of elastic strips interconnecting adjacent protectors.

* * * * *